US009607594B2

(12) United States Patent
Chon et al.

(10) Patent No.: US 9,607,594 B2
(45) Date of Patent: Mar. 28, 2017

(54) MULTIMEDIA APPARATUS, MUSIC COMPOSING METHOD THEREOF, AND SONG CORRECTING METHOD THEREOF

(71) Applicant: SAMSUNG ELECTRONICS CO., LTD., Suwon-si (KR)

(72) Inventors: Sang-bae Chon, Suwon-si (KR); Sun-min Kim, Suwon-si (KR); Sang-mo Son, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/517,995

(22) Filed: Oct. 20, 2014

(65) Prior Publication Data

US 2015/0179157 A1 Jun. 25, 2015

(30) Foreign Application Priority Data

Dec. 20, 2013 (KR) ..... 10-2013-0159906

(51) Int. Cl.
*G10H 1/18* (2006.01)
*G10H 1/00* (2006.01)

(52) U.S. Cl.
CPC ..... *G10H 1/0066* (2013.01); *G10H 1/0025* (2013.01); *G10H 2220/211* (2013.01); *G10H 2220/351* (2013.01); *G10H 2220/455* (2013.01); *G10H 2230/021* (2013.01); *G10H 2240/085* (2013.01)

(58) Field of Classification Search
CPC ..... G10H 1/18
USPC ..... 84/616
See application file for complete search history.

(56) References Cited

U.S. PATENT DOCUMENTS

| | | | |
|---|---|---|---|
| 5,281,754 | A | 1/1994 | Farrett et al. |
| 5,428,707 | A | 6/1995 | Gould et al. |
| 5,428,708 | A | 6/1995 | Gibson et al. |
| 5,763,804 | A | 6/1998 | Rigopulos et al. |
| 6,384,310 | B2 | 5/2002 | Aoki et al. |
| 7,174,510 | B2 | 2/2007 | Salter |
| 7,189,912 | B2 | 3/2007 | Jung |
| 7,619,155 | B2 | 11/2009 | Teo et al. |

(Continued)

FOREIGN PATENT DOCUMENTS

| | | |
|---|---|---|
| EP | 1 849 154 B1 | 12/2010 |
| JP | 2002-149173 A | 5/2002 |

(Continued)

OTHER PUBLICATIONS

"Everday Looper: The loop station tailor-made for the iPhone"; Mancing Dolecules; Mar. 20, 2014; 3 pages; http://www.mancingdolecules.com/everyday-looper/.

(Continued)

*Primary Examiner* — David Warren
(74) *Attorney, Agent, or Firm* — Sughrue Mion, PLLC

(57) ABSTRACT

A multimedia apparatus, a music composing method thereof, and a song correcting method thereof are provided. A music composing method includes setting a type of musical instrument digital interface (MIDI) data according to a user's input, sensing a user interaction, analyzing the sensed user interaction and determining a beat and a pitch of the user interaction, and generating MIDI data using the set type of MIDI data and the determined beat and pitch.

17 Claims, 10 Drawing Sheets

(56) References Cited

U.S. PATENT DOCUMENTS

| | | | | |
|---|---|---|---|---|
| 7,705,231 | B2 | 4/2010 | Morris et al. | |
| 8,367,922 | B2 | 2/2013 | Jung et al. | |
| 2002/0000156 | A1* | 1/2002 | Nishimoto | G10H 1/0058 84/609 |
| 2004/0182229 | A1* | 9/2004 | Jung | G10G 1/00 84/645 |
| 2006/0230910 | A1* | 10/2006 | Song | G10H 1/0025 84/616 |
| 2007/0131094 | A1* | 6/2007 | Kemp | G06F 17/30743 84/609 |
| 2007/0186750 | A1 | 8/2007 | Zhang | |
| 2008/0257133 | A1* | 10/2008 | Sasaki | G10H 1/0025 84/604 |
| 2009/0027338 | A1 | 1/2009 | Weinberg et al. | |
| 2009/0217805 | A1* | 9/2009 | Lee | G10H 7/006 84/611 |
| 2009/0249945 | A1 | 10/2009 | Yamashita et al. | |
| 2010/0325135 | A1* | 12/2010 | Chen | G06F 17/30053 707/759 |
| 2012/0144979 | A1 | 6/2012 | Tansley | |
| 2012/0312145 | A1 | 12/2012 | Kellett et al. | |
| 2015/0179157 | A1* | 6/2015 | Chon | G10H 1/0066 84/645 |
| 2015/0228264 | A1* | 8/2015 | Zhu | G10H 7/02 84/604 |

FOREIGN PATENT DOCUMENTS

| | | | |
|---|---|---|---|
| JP | 2010-66739 | A | 3/2010 |
| KR | 1999-0064283 | A | 7/1999 |
| KR | 10-2011-0107496 | A | 1/2001 |
| KR | 10-2011-0121883 | A | 1/2001 |
| KR | 10-2011-0125333 | A | 3/2001 |
| KR | 10-0363027 | B1 | 12/2002 |
| KR | 10-0412196 | B1 | 12/2003 |
| KR | 10-0658869 | B1 | 12/2006 |
| KR | 10-0705176 | B1 | 4/2007 |

OTHER PUBLICATIONS

Smule; "LaDiDa"; The App Store on iTunes; Mar. 20, 2014; 7 pages; https://itunes.apple.com/us/app/ladida/id326533688?mt=8.

Search Report issued on Mar. 11, 2015 by the International Searching Authority in related Application No. PCT/KR2014/011463.

Written Opinion issued on Mar. 11, 2015 by the International Searching Authority in related Application No. PCT/KR2014/011463.

* cited by examiner

MULTIMEDIA APPARATUS, MUSIC COMPOSING METHOD THEREOF, AND SONG CORRECTING METHOD THEREOF

CROSS-REFERENCE TO RELATED APPLICATION

This application claims priority from Korean Patent Application No. 10-2013-0159906, filed on Dec. 20, 2013, in the Korean Intellectual Property Office, the disclosure of which is incorporated herein by reference in its entirety.

BACKGROUND

Field

Apparatuses and methods consistent with the exemplary embodiments relate to a multimedia apparatus, a music composing method thereof, and a song correcting method thereof, and more particularly, to a multimedia apparatus capable of composing music according to a user interaction and correcting a song sung by a user, a music composing method thereof, and a song correcting method thereof.

Description of the Related Art

Recently, the music content production market of multimedia apparatuses, especially smart phones, has been rapidly growing.

Music content production methods use interfaces such as a musical instrument digital interface (MIDI). Such an interface can be difficult to use if one is not an expert. In order to produce music using the MIDI interface, users need to have both musical knowledge and knowledge about the MIDI interface.

In addition, in the related art, a song can only be composed by using the user's voice. That is, there are limits to composing a song using other interactions and only the user's voice can be used.

Accordingly, there is a need for an easier and more convenient method for composing music using a diverse types of user interactions.

SUMMARY

Exemplary embodiments address the above disadvantages and other disadvantages not described above. Also, the exemplary embodiments are not required to overcome the disadvantages described above, and exemplary embodiments may not overcome any of the problems described above.

An exemplary embodiment provides a multimedia apparatus capable of composing music using diverse types of user interactions and video data, and a music composing method thereof.

An exemplary embodiment also provides a multimedia apparatus capable of searching for a song sung by the user and correcting the song sung by the user, and a song correcting method thereof.

According to an aspect of an exemplary embodiment, a music composing method includes setting a type of musical instrument digital interface (MIDI) data according to a user's input, sensing a user interaction, analyzing the sensed user interaction and determining a beat and a pitch, and generating MIDI data using the set type of MIDI data and the determined beat and pitch.

In the setting the type of MIDI data including setting at least one of a genre, a style, a beats per minute (BPM), and a complexity of the MIDI data.

The method may further include receiving an image, and obtaining emotion information using at least one of color information, motion information, and spatial information of the received image. In the generating the MIDI data, the MIDI data may be generated using the emotion information.

The method may further include sensing at least one of a weather, a temperature, a humidity, and an illumination, and generating emotion information using the sensed at least one of the weather, the temperature, the humidity, and the illumination. In the generating the MIDI data, the MIDI data may be generated using the emotion information.

The method may further include generating a score using the determined beat and pitch, and displaying the generated score.

The method may further include modifying the MIDI data using the displayed generated score.

The method may further include generating a previous measure of MIDI data and a subsequent measure of MIDI data of the generated MIDI data using the generated MIDI data, and generating a music file using the generated MIDI data, the generated previous measure of MIDI data, and the generated subsequent measure of MIDI data.

The user interaction may be one of humming by the user, a touch made by the user, and a motion made by the user.

The method may further include mixing and outputting the MIDI data and the humming by the user when the user interaction is the humming by the user.

According to another aspect, a multimedia apparatus includes an inputter configured to receive a user command to set a type of musical instrument digital interface (MIDI) data, a sensor configured to sense a user interaction, and a controller configured to analyze the sensed user interaction and determine a beat and a pitch, and to generate MIDI data using the set type of MIDI data and the determined beat and pitch.

The inputter may receive a user command to set at least one of a genre, a style, a beats per minute (BPM), and a complexity of the MIDI data.

The multimedia apparatus may further include an image inputter configured to receive an image. The controller may obtain emotion information using at least one of a color information, a motion information, and a spatial information of the image received through the image inputter, and generate the MIDI data using the emotion information.

The multimedia apparatus may further include an environment sensor configured to sense at least one of a weather, a temperature, a humidity, and an illumination. The controller may generate emotion information using at least one of the weather, the temperature, the humidity, and the illumination, and generate the MIDI data using the emotion information.

The multimedia apparatus may further include a display. The controller may generate a score using the determined beat and pitch, and control the display to display the generated score.

The controller may modify the MIDI data according to a user command which is input onto the displayed score.

The controller may generate a previous measure MIDI data and a subsequent measure MIDI data of the generated MIDI data using the generated MIDI data, and generate a music file using the generated MIDI data, the generated previous measure of MIDI data, and the generated subsequent measure of MIDI data.

The user interaction may be one of humming by the user, a touch made by the user, and a motion made by the user.

The multimedia apparatus may further include an audio outputter. The controller may control the audio outputter to mix and output the MIDI data and the humming by the user when the user interaction is the humming by the user.

According to another aspect, a music composing method includes receiving video data, determining a composition parameter by analyzing the received video data, and generating musical instrument digital interface (MIDI) data using the determined composition parameter.

In the determining the composition parameter, a chord progression may be determined using color information of the received video data, a drum pattern may be determined using screen motion information of the received video data, a beats per minute (BPM) may be determined using object motion information of the received video data, or a parameter of an area of a sound image may be determined using spatial information of the received video data.

The method may further include executing the generated MIDI data together with the video data.

According to another aspect, a song correcting method includes receiving a song sung by a user, analyzing the song and obtaining a score that matches the song, synchronizing the song and the score, and correcting the received song based on the synchronized score.

In the obtaining the matching score, a pitch and a beat of the song may be analyzed, and the score that matches the song may be obtained based on the analyzed pitch and beat.

A virtual score may be generated based on the analyzed pitch and beat, and a score which is most similar to the virtual score among scores stored in a database may be acquired as the score that matches the song.

The method may further include searching for a sound source which corresponds to the song, extracting an accompaniment sound from the sound source, and mixing and outputting the corrected song and the accompaniment sound.

According to the aforementioned exemplary embodiments, general users who do not have great musical knowledge and who do not sing well may generate music contents or correct their song easily and conveniently.

Additional and/or other aspects and advantages will be set forth in part in the description which follows and, in part, will be obvious from the description, or may be learned by practice.

BRIEF DESCRIPTION OF THE DRAWINGS

The above and/or other aspects will be more apparent by describing certain exemplary embodiments with reference to the accompanying drawings, in which.

DETAILED DESCRIPTION OF THE EXEMPLARY EMBODIMENTS

Figure 1:
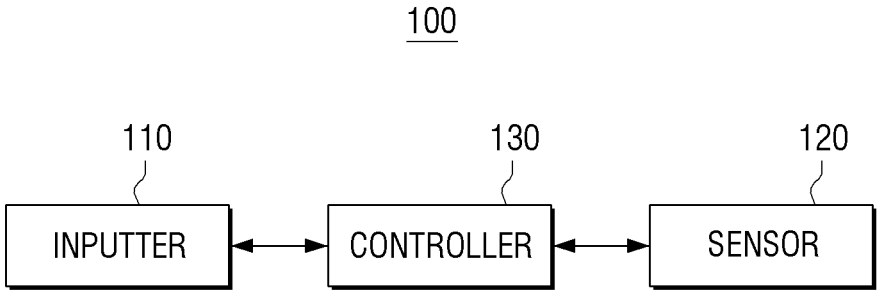
FIG. 1 is a block diagram of a configuration of a multimedia apparatus according to an exemplary embodiment.

Certain exemplary embodiments will now be described in greater detail with reference to the accompanying drawings.

In the following description, same drawing reference numerals are used for the same elements even in different drawings. The matters defined in the description, such as detailed construction and elements, are provided to assist in a comprehensive understanding of the exemplary embodiments. Thus, it is apparent that the exemplary embodiments can be carried out without those specifically defined matters. Also, well-known functions or constructions are not described in detail since they would obscure the invention with unnecessary detail.

FIG. 1 is a block diagram of a configuration of a multimedia apparatus according to an exemplary embodiment. With reference to FIG. 1, the multimedia apparatus 100 may include an inputter 110, a sensor 120, and a controller 130.

The inputter 110 receives a user command to control the overall operation of the multimedia apparatus 100. In particular, the inputter 110 may receive a user command to set a type of musical instrument digital interface (MIDI) data that the user wishes to compose. The type of the MIDI data may include at least one of a genre, a style, a beats per minute (BPM), and a complexity of the MIDI data.

The sensor 120 senses a user interaction in order to compose music. The sensor 120 may include at least one of a microphone to sense if the user is humming, a motion sensor to sense a motion by the user, and a touch sensor to sense a touch made by the user.

The controller 130 controls the multimedia apparatus 100 according to a user command input through the inputter 110. In particular, the controller 130 determines a beat and a pitch by analyzing sensed user interaction, and generates MIDI data using a set type of MIDI data and the determined beat and pitch.

The controller 130 determines a type of MIDI data set through the inputter 110. More specifically, the controller 130 may determine at least one of a genre, an S Type, a BPM, and a complexity of MIDI data set through the inputter 110.

In addition, the controller 130 determines a beat and a pitch using one of the user's humming, the user's motion, and the user's touch sensed by the sensor 120. For example, when a user hums and the humming is input through a microphone, the controller 130 may determine a beat of the user's humming using a harmonic cepstrum regularity (HCR) method, and may determine a pitch of the user's humming using correntropy pitch detection. When the user inputs a motion through a motion sensor, the controller 130 may determine the beat using a speed of the user's motion, and determine a pitch using the distance of the motion. When the user's touch is input through a touch sensor, the controller 130 may determine the beat by calculating the time at which the user touches the touch sensor, and determine a pitch by calculating an amount of pressure of a user's touch.

In addition, the controller 130 generates MIDI data using a type of MIDI data input through the inputter 110 and determines a beat and a pitch.

In addition, the controller 130 may acquire emotion information using at least one of color information, motion information, and spatial information of an image input through an image inputter (not shown), and generate MIDI data using the emotion information. The emotion information is information regarding the mood of the music that the user wishes to compose, including information to determine chord progression, drum pattern, beats per minute (BPM), and spatial impression information. More specifically, the controller 130 may determine chord progression of MIDI data using color information of the input image, determine drum pattern or BPM of MIDI data using motion information of the input image, and acquire spatial impression of MIDI data using spatial information extracted from an input audio signal.

In another exemplary embodiment, the controller 130 may generate emotion information using at least one of weather information, temperature information, humidity information, and illumination information sensed by an environment sensor (not shown) of the multimedia apparatus 100, and generate MIDI data using the emotion information.

In addition, the controller 130 may generate a score using a determined beat and pitch, and display the generated score. The controller 130 may correct MIDI data according to a user command which is input onto the displayed score.

In addition, the controller 130 may generate a previous measure of MIDI data and a subsequent measure of MIDI data using generated MIDI data, and generate a music file using the generated MIDI data, the generated previous measure of MIDI data, and the generated subsequent measure of MIDI data. More specifically, when four measures having a C-B-A-G chord composition are currently generated, measures may be extended using harmonic characteristics that a next measure is likely to have such as a chord including F-E-D-C or F-E-D-E. A chord progression of C-B-A-G is likely to appear in front of F-E-D-C.

When the user interaction is the user humming, the controller 130 may mix and output MIDI data and the user's humming. In addition, when video data is input, the controller 130 may synchronize and output the MIDI data and the video data.

By using the multimedia apparatus 100, general users who do not have extensive musical knowledge and who may not sing very well may generate music contents easily and conveniently.

Figure 2:
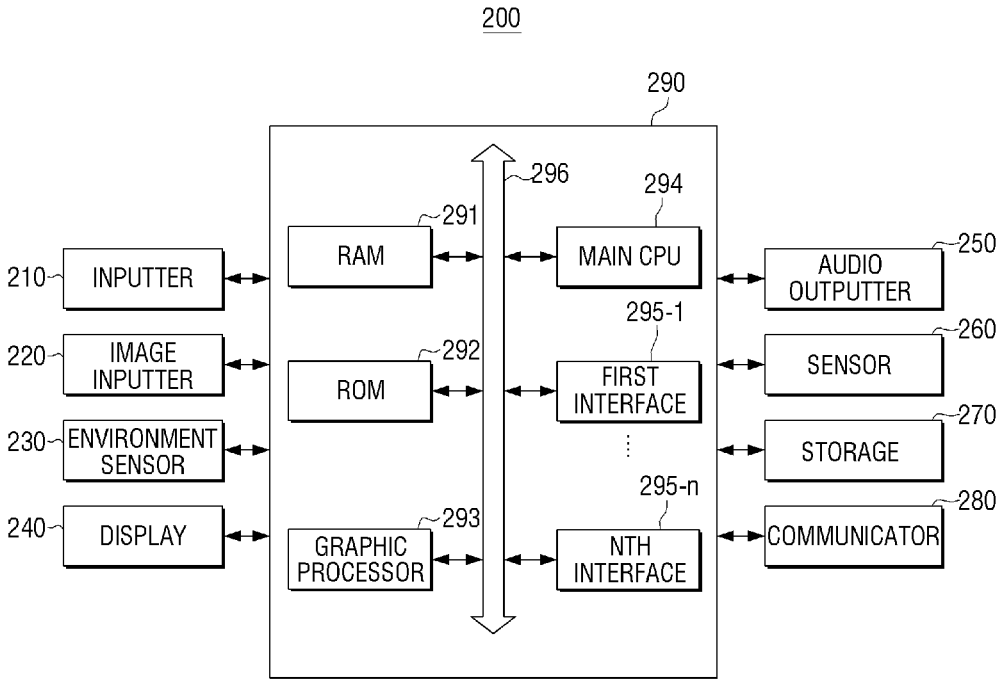
FIG. 2 is a detailed block diagram of a configuration of a multimedia apparatus according to an exemplary embodiment.

FIG. 2 is a detailed block diagram of a configuration of a multimedia apparatus 200 according to an exemplary embodiment. With reference to FIG. 2, the multimedia apparatus 200 may include an inputter 210, an image inputter 220, an environment sensor 230, a display 240, an audio outputter 250, a sensor 260, a storage 270, a communicator 280, and a controller 290.

The multimedia apparatus 200 as shown in FIG. 2 is a multimedia apparatus which performs diverse functions such as a music composing function, a song correcting function, and the like. Accordingly, when other functions are added or functions change, components may be added or changed.

The inputter 210 receives a user command to control the multimedia apparatus 200. In particular, the inputter 210 receives a user command to set a type of MIDI data. More specifically, the inputter 210 may receive a user command to set a type of MIDI data such as a genre, a style, a BPM, and a complexity of music that the user wishes to compose. The user may select a genre of music such as rock, ballad, rap, and jazz through the inputter 210. In addition, the user may select a style such as gloomy, pleasant, heavy, and dreamy through the inputter 210. Also, the user may adjust a complexity by reducing or increasing the number of instruments or tracks through the inputter 210. In addition, the user may adjust the BPM, which is the number of quarter notes per minute, through the inputter 210. Also, the user may adjust the tempo, which is the rate of quarter notes, half notes, and whole notes, through the inputter 210.

The image inputter 220 receives image data externally. More specifically, the image inputter 220 may receive broadcast image data from an external broadcasting station, receive streaming image data from an external server, or receive image data from an external device (for example, a DVD player, etc). In addition, the image inputter 220 may receive personal content, such as home video, personally recorded by the user. In particular, when the image inputter 220 is implemented in devices such as a smart phone, the image inputter 220 may receive image data from a video library of the user stored in, for example, the smart phone or stored externally.

The environment sensor 230 senses an external environment. More specifically, the environment sensor 230 may acquire weather information externally, acquire temperature information of an area at which the multimedia apparatus 200 is located by using a temperature sensor, acquire humidity information of an area at which the multimedia apparatus 200 is located using a humidity sensor, or acquire illumination information of an area at which the multimedia apparatus 200 is located by using an illumination sensor. In addition, the environment sensor 230 may acquire weather and time information by linking the multimedia apparatus 200 with an internet service using the location information of the user.

The display 240 may be controlled by the controller 290 to display diverse types of image data. In particular, the display 240 may display image data input through the image inputter 220.

Figure 4:
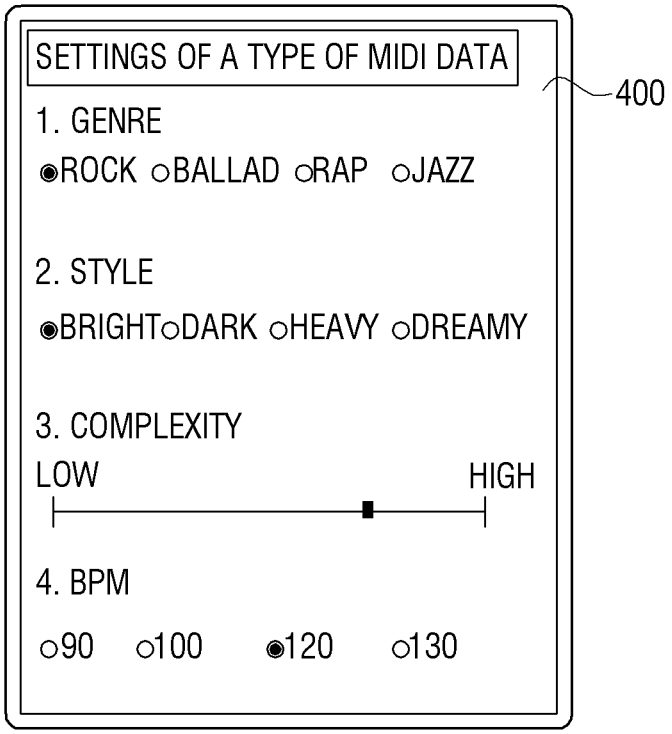
FIG. 4 illustrates a user interface to set a type of MIDI data according to an exemplary embodiment.

In addition, the display 240 may display diverse types of user interfaces (UIs) to control the multimedia apparatus 200. For example, the display 240 may display a UI to set a type of MIDI data as shown in FIG. 4.

Figure 5:
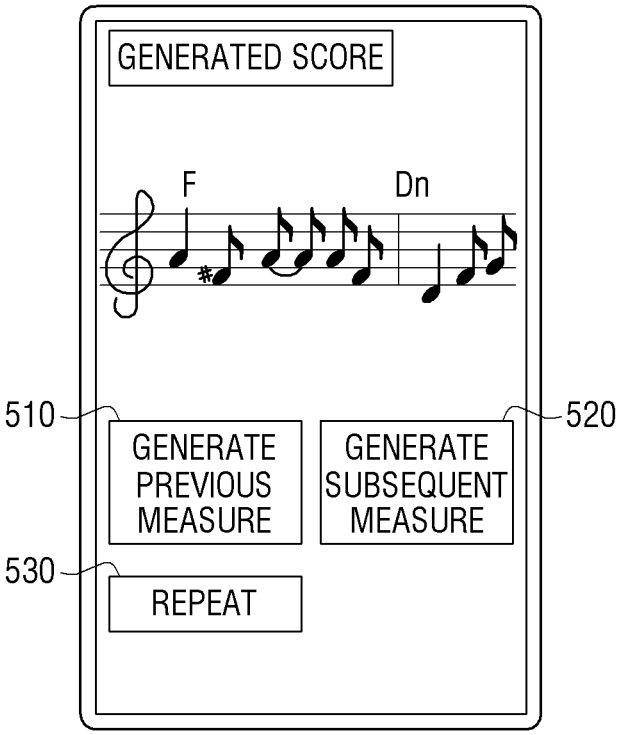
FIG. 5 illustrates a score generated using user interaction according to an exemplary embodiment.

In addition, the display 240 may display a score having a pitch and a beat which is determined according to a user interaction. For example, the display 240 may display a score as shown in FIG. 5.

The audio outputter 250 may output audio data. The audio outputter 250 may output not only externally input audio data but also MIDI data generated by user interaction.

The sensor 260 senses a user interaction. In particular, the sensor 260 may sense user interaction to compose music. More specifically, the sensor 260 may sense various and diverse types of user interactions to determine a beat and a pitch of music that the user wishes to compose. For example, the sensor 260 may sense whether the user is humming by using a microphone, sense whether the user is making a motion by using a motion sensor, or sense whether the user is touching the apparatus by using a touch sensor. Therefore, the sensor 260 can include, for example, a microphone, a motion sensor or a touch sensor.

The storage 270 stores diverse modules to drive the multimedia apparatus 200. For example, the storage 270 may include software including a base module, a sensing module, a communication module, a presentation module, a web browser module, and a service module (not shown). The base module is a module that processes a signal transmitted from hardware included in the multimedia apparatus 200 and transmits the signal to an upper layer module. The sensing module is a module that collects information from diverse sensors and analyzes and manages the collected information, including a face recognition module, a voice recognition module, a motion recognition module, a near field communication (NFC) recognition module, and so on. The presentation module is a module that composes a display screen, including a multimedia module to play back and output multimedia content and a user interface (UI) rendering module to process UIs and graphics. The communication module is a module that communicates with external devices. The web browser module is a module that performs web browsing and accesses a web server. The service module is a module including diverse applications to provide diverse services.

Figure 3:
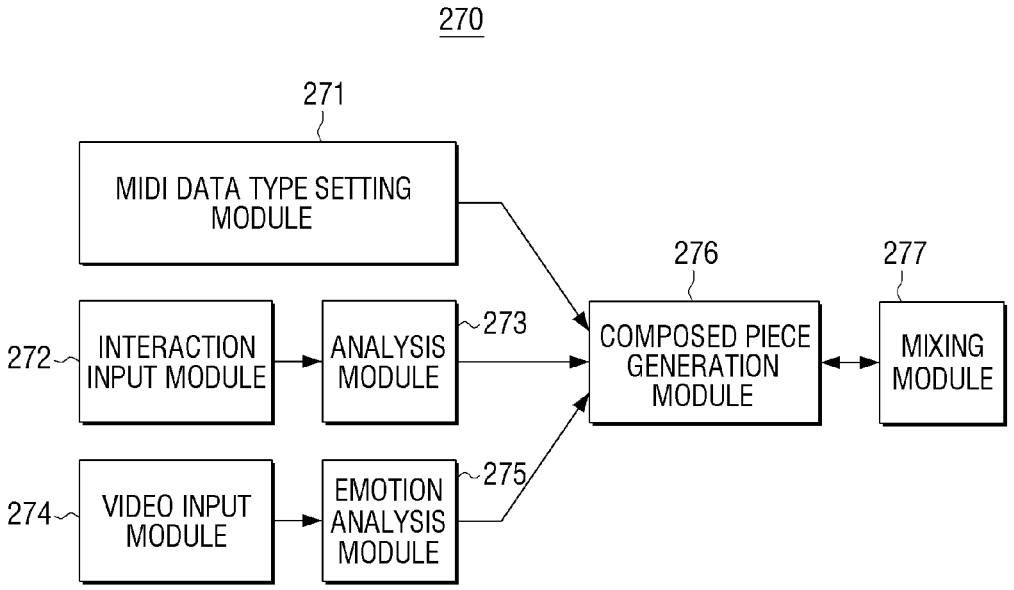
FIG. 3 illustrates diverse modules to compose music according to an exemplary embodiment.

In addition, the storage 270 may store diverse modules to compose music according to a user interaction. This is described with reference to FIG. 3. The modules to compose music according to user interaction may include a MIDI data type setting module 271, an interaction input module 272, an analysis module 273, a video input module 274, an emotion analysis module 275, a composed piece generation module 276, and a mixing module 277.

The MIDI data type setting module 271 may set a type of the MIDI data according to a user command which is input through the inputter 210. More specifically, the MIDI data type setting module 271 may set diverse types of MIDI data such as genre, BPM, style, and complexity of the MIDI data.

The interaction input module 272 receives a user interaction sensed by the sensor 260. More specifically, the interaction input module 272 may receive a user interaction including at least one of the user's humming, a user's motion, and a user's touch.

The analysis module 273 may analyze the user interaction input through the interaction input module 272, and thus determine a pitch and a beat. For example, when a user hums and the humming is input through a microphone, the analysis module 273 may determine a beat of the user's humming using a harmonic cepstrum regularity (HCR) method, and determine a pitch of the user's humming using correntropy pitch detection. When the user's motion is input through a motion sensor, the analysis module 273 may determine a beat using a speed of the user's motion, and determine a pitch using the distance of the motion. When the user's touch is input through a touch sensor, the analysis module 273 may determine the beat by calculating a time at which the user touches the touch sensor, and determine the pitch by calculating an amount of pressure touched by the user on the touch sensor.

The video input module 274 receives video data input through the image inputter 220, and outputs the video data to the emotion analysis module 275.

The emotion analysis module 275 may analyze the input video data and thus determine emotion information of MIDI data. The emotion information of the MIDI data is information regarding the mood of the music that the user wishes to compose, including information such as chord progression, drum pattern, BPM, and spatial impression information. More specifically, the emotion analysis module 275 may determine a chord progression of the MIDI data using color information of an input image. For example, when brightness or chroma of an image is high, the emotion analysis module 275 may determine a bright major chord progression, that is, a chord progression which gives a sense of brightness, and when brightness or chroma is low, the emotion analysis module 275 may determine a dark minor chord progression, that is a chord progression which gives a sense of darkness.

The emotion analysis module 275 may determine a drum pattern or BPM of the MIDI data using motion information of an input image. For example, the emotion analysis module 275 may presume a certain BPM from a degree of motion of the entire clip, and then increase the complexity of a drum pattern at a portion having a lot of motion. The emotion analysis module 275 may acquire spatial impression information of the MIDI data using spatial information of the input video so that the acquired spatial impression may be used to form a spatial impression when multichannel audio is generated.

The composed piece generation module 276 generates MIDI data which is a composed piece, based on a type of the MIDI data set by the MIDI data type setting module 271, a pitch and a beat determined by the analysis module 273, and emotion information determined by the emotion analysis module 275.

The composed piece generation module 276 may also generate a score image corresponding to the generated MIDI data.

In addition, the composed piece generation module 276 may generate a previous measure of MIDI data and a subsequent measure of MIDI data using the MIDI data generated according to the user's settings. More specifically, the composed piece generation module 276 may generate a previous measure of MIDI data and a subsequent measure of MIDI data of MIDI data generated based on a general composition pattern set by the user, a type of MIDI data set by the user, a chord progression determined by the emotion analysis module 275, etc.

The mixing module 277 mixes an input MIDI data with the user's humming or video data.

Diverse types of modules, as well as the aforementioned modules, may be added, or the aforementioned modules may be changed. For example, an environment information input module may be added to receive surrounding environment information sensed by the environment sensor 230.

Returning to FIG. 2, the communicator 280 communicates with various types of external devices according to various types of communication methods. The communicator 280 may include various communication chips such as a wireless fidelity (Wi-Fi) chip, a Bluetooth chip, a near field communication (NFC) chip, and a wireless communication chip. The Wi-Fi chip, the Bluetooth chip, and the NFC chip perform communication according to a Wi-Fi method, a Bluetooth method, and an NFC method, respectively. The NFC chip is a chip that operates according to the NFC method which uses a 13.56 MHz band among diverse radio frequency identification (RFID) frequency bands such as 135 kHz, 13.56 MHz, 433 MHz, 860-960 MHz, and 2.45 GHz. In the case that a Wi-Fi chip or a Bluetooth chip is used, connection information such as a subsystem identification (SSID) and a session key are transmitted and received first, and then after communication is established, diverse information can be transmitted and received. The wireless communication chip is a chip that performs communication according to diverse communication standards such as IEEE, Zigbee, $3^{rd}$ generation (3G), $3^{rd}$ generation partnership project (3GPP), and long term evolution (LTE).

The controller 290 may include a random-access memory (RAM) 291, a read-only memory (ROM) 292, a graphic processor 293, a main central processing unit (CPU) 294, first to $N^{th}$ interfaces 295-1 to 295-N, and a bus 296 as shown in FIG. 2. The RAM 291, the ROM 292, the graphic processor 293, the main CPU 294, and the first to $N^{th}$ interfaces 295-1 to 295-N may be connected to one another via the bus 296.

The ROM 292 stores a set of commands to boot up the system. When a command to turn on the multimedia apparatus 200 is input and power is supplied, the main CPU 294 copies an operating system (OS) stored in the storage 270 to the RAM 291 and executes the OS according to the commands stored in the ROM 292 so that the system can boot up. When the boot-up is complete, the main CPU 294 copies diverse application programs stored in the storage 270 to the RAM 291, and runs the copied application programs so that various operations can be performed.

The graphic processor 293 generates images to be displayed on a screen on a display area of the display 240 including diverse objects such as an icon, an image, and text, using an operator (not shown) and a renderer (not shown). The operator operates property values of each object, such as a coordinate value, a shape, a size and a color, according to the layout of the screen by using a control command received from the inputter 210. The renderer generates an image on the screen having a diverse layout including objects based on the property values operated by the operator. The screen generated by the renderer is displayed on a display area of the display 240.

The main CPU 294 accesses the storage 270 and boots up the system using the OS stored in the storage 270. In addition, the main CPU 294 performs various operations using different types of programs, contents, and data stored in the storage 270.

The first to $N^{th}$ interfaces 295-1 to 295-N are connected to the aforementioned components. One of the interfaces may be a network interface that is connected to an external device through a network.

The controller 290 may determine a beat and a pitch by analyzing a sensed user interaction, and generates MIDI data by using a type of MIDI data, which is set according to a user command input through the inputter 110, and by using the determined beat and pitch.

More specifically, when a command to run a music application is input so as to compose music, the controller 290 may control the display 240 to display a UI 400 to set a type of MIDI data, as shown in FIG. 4. The controller 290 may set various types of MIDI data such as genre, style, complexity, BPM, and tempo according to a user command input through the UI 400, as shown in FIG. 4.

When the controller 290 senses a user interaction through the sensor 260 after setting a type of the MIDI data, the controller 290 may analyze the user interaction and determine a pitch and a beat corresponding to the user interaction.

More specifically, if a user hums into a microphone, the controller 290 may determine a beat of the user's humming using a harmonic cepstrum regularity (HCR) method, and determine a pitch of the user's humming using correntropy pitch detection. The harmonic structure changes sharply at the point at which the humming first starts. Accordingly, the controller 290 may determine a beat by determining a point on which onset of the humming occurs using the HCR method. In addition, the controller 290 may determine a pitch using a signal between onsets of the humming according to correntropy pitch detection.

As another example, a pitch and beat can be determined according to a motion made by the user. When the user's motion is input through a motion sensor, the controller 290 may determine a beat using the speed of the user's motion, and determine a pitch using the distance of the motion. That is, as the user's motion is faster, the controller 290 may determine that the beat is faster, and as the user's motion becomes slower, the controller 290 may determine that beat is slower. In addition, as the distance of the motion of the user sensed by the motion sensor is shorter, the controller 290 may determine that the pitch is lower, and as the distance of the motion of the user sensed by the motion sensor is longer, the controller 290 may determine that the pitch is higher.

As another example, a pitch and beat can be determined if a user touches the touch screen or touch panel, such as the display 240, of the multimedia apparatus 200. When the user's touch is input through a touch sensor, the analysis module 273 may determine a beat by calculating a time at which the user touches the touch sensor, and determine a pitch by calculating a position on a touch screen touched by the user. That is, if the user touches the touch screen for a longer period of time, the controller 290 may determine that the beat is slower, and if the user touches the screen for a short period of time, the controller 290 may determine that the beat is faster. In addition, the controller 290 may determine the pitch according to an area of the touch screen touched by the user.

The controller 290 may determine emotion information based on video data which is input or based on sensed surrounding environment information. The emotion information of the MIDI data indicates information regarding the mood of music that the user wishes to compose, including information such as chord progression, a drum pattern, BPM, and spatial impression information.

More specifically, the controller 290 may acquire emotion information using at least one of color information, motion information, and spatial information of an image input through an image inputter 220. For example, the controller 290 may determine the chord progression of MIDI data using the color information of an input image. More specifically, when the input image has many bright colors, the controller 290 may determine that the chord of the MIDI data is a major chord, and when the input image has many dark colors, the controller 290 may determine that chord of the MIDI data is a minor chord.

As another example, the controller 290 may determine a drum pattern or BPM of MIDI data using motion information of an input image. More specifically, when the input image has a lot of motion, the controller 290 may increase the BPM, and when the input image has a little bit of motion, the controller 290 may decrease the BPM.

Also, in another example, the controller 290 may acquire spatial impression information of MIDI data using the spatial information of the input video. More specifically, the controller 290 may extract an area parameter of a sound image of a composed piece using spatial information of the input video.

In addition, the controller 290 may acquire emotion information based on the surrounding environment information sensed by the environment sensor 230. For example, when the weather is sunny, when the temperature is warm, or when illumination is bright, the controller 290 may determine that the chord of the MIDI data is a major chord. When the weather is dark, when the temperature is cold, or when illumination is dark, the controller 290 may determine that the chord of the MIDI data is a minor chord.

When a type of MIDI data is not set by the user, the controller 290 may determine a type of MIDI data using surrounding environment information or video data. For example, when the weather is sunny, the controller 290 may set a genre of the MIDI data to be dance.

In addition, the controller 290 may generate a score using the determined beat and pitch, and may control the display 240 to display the generated score. More specifically, the controller 290 may generate a score using a beat and a pitch determined according to a user interaction as shown in FIG. 5. With reference to FIG. 5, the score may include different icons such as icon 510, icon 520, and icon 530 to generate a music file as well as the score determined according to user interaction. For example, the diverse icons may include a first icon 510 to generate a previous measure of MIDI data in front of a currently generated MIDI data, a second icon 520 to generate a rear measure of MIDI data behind the currently generated MIDI data, and a third icon 530 to repeat the currently generated MIDI data, as shown in FIG. 5.

At this time, the controller 290 may generate the previous measure of MIDI data or the rear measure of MIDI data using an existing database. In other words, the controller 290 may store a composition pattern of the user in the database, and predict and generate a previous measure or a rear measure of a currently generated MIDI data based on the stored composition pattern. For example, when a chord of four measures of a currently generated MIDI data is C-B-A-G, the controller 290 may set a chord of a subsequent measure to be C-D-G-C or F-E-D-C based on the database. In addition, when a chord of four measures of a currently generated MIDI data is C-D-G-C, the controller 290 may set a chord of a previous measure to be C-B-A-G based on the database.

In addition, the controller 290 may modify the MIDI data according to a user command which is input on a displayed score. In particular, when the display 240 includes a touch panel or touch screen, the controller 290 may modify the MIDI data using the user's touch input to a score as shown in FIG. 5. When a user command is input to touch and drag a musical note, the controller 290 may modify the pitch of the touched note, and when a user command is input in which the user touches the note for more than a predetermined period of time, the controller 290 may modify the beat. However, this is merely an exemplary embodiment. The controller 290 may modify diverse composition parameters using other user commands.

When the user interaction is the user humming, the controller 290 may control the audio outputter 250 to mix and output MIDI data and the user's humming. In addition, when video data is input through the image inputter 220, the controller 290 may control the audio outputter 250 and the display 240 to mix and output the input video data and the MIDI data.

Figure 6:
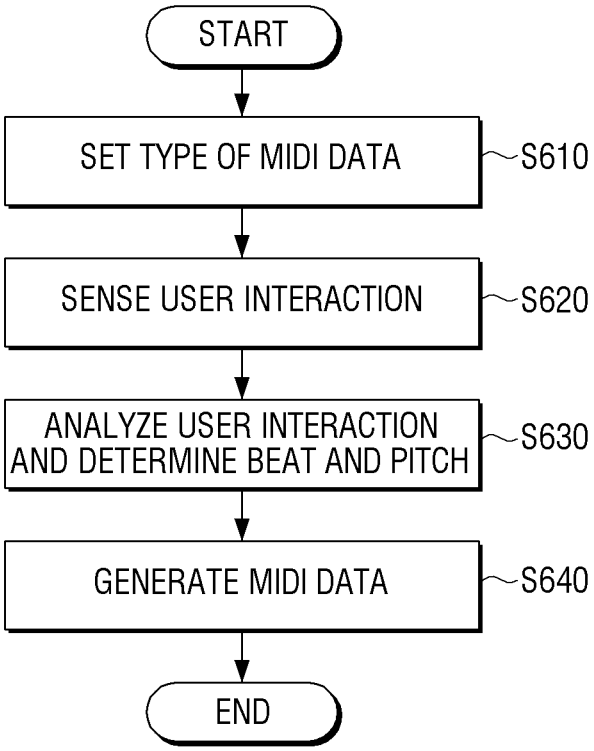
FIG. 6 is a flowchart of a method for composing music using user interaction according to an exemplary embodiment.

FIG. 6 is a flowchart of a method for composing music using a user interaction according to an exemplary embodiment.

First, the multimedia apparatus 200 sets a type of the MIDI data according to the user's input (S610). The type of MIDI data may include at least one of a genre, a style, a BPM, and a complexity of the MIDI data.

Subsequently, the multimedia apparatus 200 senses a user interaction with the multimedia apparatus 200 (S620). The user interaction may include at least one of the user humming into the microphone of the multimedia apparatus, touching a touch screen, and making a motion which is sensed by the multimedia apparatus.

The multimedia apparatus 200 analyzes the user interaction and determines a beat and a pitch (S630). More specifically, when the user's humming is input through a microphone, the multimedia apparatus 200 may determine a beat of the user's humming using the HCR method, and determines a pitch of the user's humming using correntropy pitch detection. When the user's motion is input through a motion sensor, the multimedia apparatus 200 may determine a beat using a speed of the user's motion, and determine a pitch using the distance of the motion. When the user's touch is input through a touch sensor, the multimedia apparatus 200 may determine a beat by calculating a time at which the user touches the multimedia apparatus 200, and determine a pitch by calculating an amount of pressure placed by the user on, for example, the touch sensor of the multimedia apparatus 200.

Subsequently, the multimedia apparatus 200 generates MIDI data based on the set type of the MIDI data and the determined pitch and beat (S640). At this time, the multimedia apparatus 200 may display a score of the generated MIDI data, and mix and output the generated MIDI data with the user's humming or video data.

By using the multimedia apparatus 200, the user may easily and conveniently generate the MIDI data of music that the user wishes to compose.

In the above exemplary embodiment, the user's humming is sensed using a microphone, but this is merely an exemplary embodiment. Instead, audio data in which the user's humming is recorded may be input.

In the above exemplary embodiments, a method for composing music using a user interaction has been described, but this is merely an exemplary embodiment. It is also possible to compose music using video data. This is described with reference to FIGS. 7 and 8.

Figure 7:
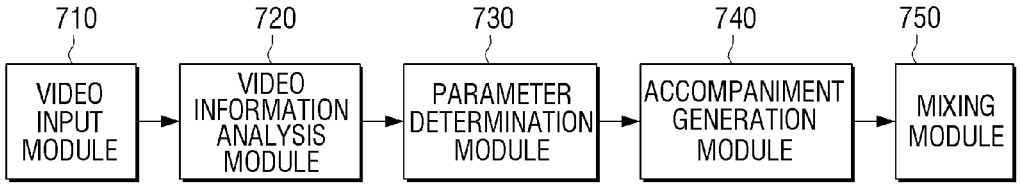
FIG. 7 illustrates a plurality of modules to compose music using video data according to an exemplary embodiment.

FIG. 7 illustrates a plurality of modules to compose music using video data according to an exemplary embodiment. With reference to FIG. 7, in order to compose music using video data, the storage 270 may include a video input module 710, a video information analysis module 720, a parameter determination module 730, an accompaniment generation module 740, and a mixing module 750.

The video input module 710 receives video data through the image inputter 220.

The video information analysis module 720 analyzes information regarding the input video data. More specifically, the video information analysis module 720 may analyze color information of the entire image, screen motion information according to a position of a camera, object motion information in the video, and spatial information extracted from an audio input signal.

The parameter determination module 730 determines a composition parameter based on the analyzed video information. More specifically, the parameter determination module 730 may determine a chord progression using the analyzed color information. For example, when analyzed color information is a bright or warm color, the parameter determination module 730 may determine that the chord progression is a major chord progression, and when the analyzed color information is a dark or cool color, the parameter determination module 730 may determine that the chord progression is a minor chord progression.

In addition, the parameter determination module 730 may determine a drum pattern using screen motion information. For example, when a screen motion or motion on a screen is fast, the parameter determination module 730 may determine that the drum pattern is fast, and when the motion on the screen is fixed, the parameter determination module 730 may determine that the drum pattern is slow. In addition, the parameter determination module 730 may determine BPM using the object motion information. For example, when the object motion is slow, the parameter determination module 730 may determine that the BPM is low, and when the object motion is fast, the parameter determination module 730 may determine that the BPM is high.

Also, the parameter determination module 730 may adjust an area of a sound image using spatial information. For example, when a space of an audio signal is large, the parameter determination module 730 may determine that an area of a sound image is large, and when a space of an audio signal is small, the parameter determination module 730 may determine that an area of a sound image is small.

The accompaniment generation module 740 generates MIDI data using the composition parameter determined by the parameter determination module 730. More specifically, the accompaniment generation module 740 generates MIDI tracks of melody instruments (for example, piano, guitar, keyboard, etc), percussion instruments (for example, drum, etc), and bass rhythm instruments (for example, bass, etc) using a composition parameter determined by the parameter determination module 730. Subsequently, the accompaniment generation module 740 may generate complete MIDI data using the generated MIDI tracks of the melody instruments, percussion instruments, and bass rhythm instruments.

The mixing module 750 may mix the generated MIDI data with video data. In particular, the mixing module 750 may locate a sound image to correspond to spatial information of an audio signal included in the video data, and generate space sense according to spatial information of an audio signal included in the video data using a decorrelator.

The controller 290 may compose music according to input video data using the modules 710 to 750 as shown in FIG. 7. More specifically, when video is input through the image inputter 220, the controller 290 may analyze the input video data, determine a composition parameter, and generate MIDI data using the determined composition parameter. The composition parameter is a parameter to compose music, such as a chord progression, a drum pattern, BPM, and an area parameter.

In particular, the controller 290 may determine a chord progression using color information of the input video data. When the color of the entire image of the input video is bright, the controller 290 may determine that the chord progression of MIDI data is a major chord progression, and when the color of the entire image of the input video is dark, the controller 290 may determine that the chord progression of the MIDI data is a minor chord progression.

In addition, the controller 290 may determine a drum pattern using screen motion information of the input video data. More specifically, when the motion on the screen of the input image is fast, the controller 290 may determine that the drum pattern is fast, and when the motion on the screen of the input image is fixed, the controller 290 may determine that the drum pattern is slow.

In addition, the controller 290 may determine BPM using object motion information of the input video data. More specifically, when the motion of a particular object in the input image is slow, the controller 290 may determine that BPM is low, and when the motion of a particular object in the input image is fast, the controller 290 may determine that BPM is high.

In addition, the controller 290 may adjust an area of a sound image using spatial information of an audio signal included in the input video data. More specifically, when a space of an audio signal is large, the controller 290 may determine that an area of a sound image is large, and when a space of an audio signal is small, the controller 290 may determine that an area of a sound image is small.

The controller 290 may generate MIDI data using a determined parameter. More specifically, the controller 290 generates a MIDI track of melody instruments (for example, piano, guitar, keyboard, etc) using a template based on a determined chord progression and genre set by the user, generates a MIDI track of percussion instruments (for example, a drum, etc) using a drum pattern, and generates a MIDI track of bass rhythm instruments (for example, bass, etc) using a chord progression, a genre, and a drum pattern. Subsequently, the controller 290 may generate complete MIDI data using the generated MIDI tracks of the melody instruments, percussion instruments, and bass rhythm instruments.

In addition, the controller 290 may run the generated MIDI data together with the video data. In other words, the controller 290 may mix and output the generated MIDI data with the video data. At this time, the controller 290 may synchronize the MIDI data and audio signals included in the video data.

Figure 8:
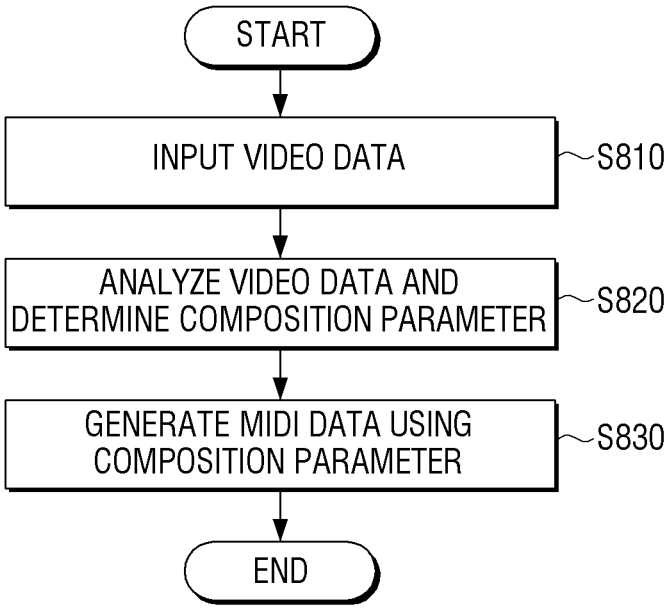
FIG. 8 is a flowchart of a method for composing music using video data according to another exemplary embodiment.

FIG. 8 is a flowchart of a method for composing music using video data according to another exemplary embodiment.

First, the multimedia apparatus 200 receive video data (S810). The multimedia apparatus 200 may receive video data from an external device, or may receive pre-stored video data.

Subsequently, the multimedia apparatus 200 analyzes the input video data and determines a composition parameter (S820). The composition parameter is a parameter to compose music, such as a chord progression, a drum pattern, BPM, and an area parameter. More specifically, the multimedia apparatus 200 may determine a chord progression using the analyzed color information. In addition, the multimedia apparatus 200 may determine a drum pattern using screen motion information of the video data. In addition, the multimedia apparatus 200 may determine BPM using object motion information of the video data. Also, the multimedia apparatus 200 may adjust an area of a sound image using spatial information.

Subsequently, the multimedia apparatus 200 generates MIDI data using the composition parameter (S830). More specifically, the multimedia apparatus 200 may generate MIDI tracks of melody instruments, percussion instruments, and bass rhythm instruments using the composition parameter, and generate MIDI data by mixing the generated MIDI tracks. In addition, the multimedia apparatus 200 may run the generated MIDI data together with the video data.

As described above, MIDI data is generated using video data so that the user may compose music suitable with the mood of the video data.

In the exemplary embodiments, music is composed using a pitch and a beat detected based on, for example, the user's humming, but this is merely an exemplary embodiment. In other exemplary embodiments, the pitch and beat can be detected based on a song sung by the user and the song is obtained based on the detected pitch and beat and the song sung by the user is corrected based on the obtained song.

Figure 9:
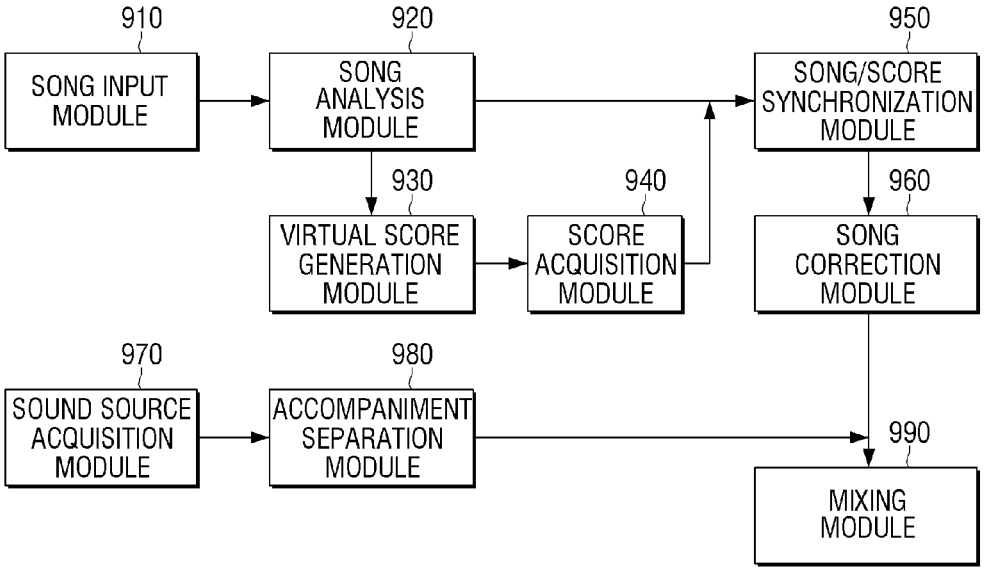
FIG. 9 illustrates a plurality of modules to correct a song according to yet another exemplary embodiment.

FIG. 9 illustrates a plurality of modules to correct a song according to yet another exemplary embodiment. With reference to FIG. 9, the storage 270 of the multimedia apparatus 200 may include a song input module 910, a song analysis module 920, a virtual score generation module 930, a score acquisition module 940, a song and score synchronization module 950, a song correction module 960, a sound source acquisition module 970, an accompaniment separation module 980, and a mixing module 990 in order to correct a song sung by the user.

The song input module 910 receives a song sung by the user. At this time, the song input module 910 may receive a song input through a microphone, or a song included in audio data.

The song analysis module 920 analyzes a beat and a pitch of the song sung by the user. More specifically, the song analysis module 920 determines a beat of the song using an HCR method, and determines a pitch of the song using correntropy pitch detection.

The virtual score generation module 930 generates a virtual score based on the pitch and beat analyzed by the song analysis module 920.

The score acquisition module 940 acquires a score of the song sung by the user using the virtual score generation module 930. The score acquisition module 940 may acquire the score by comparing a score stored in the database with the virtual score. In another exemplary embodiment, the score acquisition module 940 may acquire the score by taking a photograph of a printed score using a camera and analyzing the captured image. In another exemplary embodiment, the score acquisition module 940 may acquire the score using musical notes input by the user on manuscript paper which is displayed on the display 240.

In yet another exemplary embodiment, the score acquisition module 940 may acquire a score by comparing the song sung by the user with a vocal track extracted from a pre-stored sound source. In addition, the score acquisition module 940 may acquire a score by stochastically presuming an onset and offset pattern and dispersion of pitch based on frequency characteristics of the song which was input. At this time, the score acquisition module 940 may presume a beat and a pitch from the input song using the HCR method and correntropy pitch detection, extract stochastically the most suitable BPM and chord from dispersion of the presumed beat and pitch, and thus generate a score.

The song and score synchronization module 950 synchronizes the song sung by the user and the score acquired by the score acquisition module 940. At this time, the song and score synchronization module 950 may synchronize the song which was sung and the score using a dynamic time warping (DTW) method. The DTW method is an algorithm that finds an optimum warping path by comparing the similarity between two sequences.

The song correction module 960 corrects a wrong portion, for example, an off-key portion, an off-beat portion, etc, of the song sung by the user by comparing the song and the score. More specifically, the song correction module 960 may correct the song to correspond to the score by applying time stretching and a frequency shift.

The sound source acquisition module 970 acquires a sound source of the song sung by the user. At this time, the sound source acquisition module 970 may acquire a sound source using a score acquired by the score acquisition module 940.

The accompaniment separation module 980 separates a vocal track and an accompaniment track from the acquired sound source, and outputs the accompaniment track to the mixing module 990.

The mixing module 990 mixes and outputs the accompaniment track separated by the accompaniment separation module 980 with the song corrected by the song correction module 960.

The controller 290 corrects a song sung by the user using the exemplary modules as shown in FIG. 9.

More specifically, when a song sung by the user is input, the controller 290 analyzes the song and acquires a score that matches the song. The controller 290 determines a beat of the song using an HCR method, and determines pitch of the song using correntropy pitch detection. In addition, the controller 290 may generate a virtual score based on the determined beat and pitch, and acquire a score which is the most similar to the virtual score among the scores stored in the database, as a score corresponding to the song. In another exemplary embodiment, the controller 290 may acquire a score by the user's input, acquire a score using a photographed score image, acquire a score from a vocal track separated from a pre-stored sound source, or use the virtual score as a score corresponding to the song.

When the score is acquired, the controller 290 synchronizes the score and the song sung by the user. At this time, the controller 290 may synchronize the score and the song using a DTW method.

In addition, the controller 290 corrects the song based on the synchronized score. More specifically, the controller 290 may correct a pitch and a beat of the song by applying time stretching and a frequency shift so that the song is synchronized with the score.

In addition, the controller 290 controls the audio outputter 250 to output the corrected song.

In another exemplary embodiment, the controller 290 searches for a sound source which matches the song sung by the user. The controller 290 may search for the sound source using a score or according to the user's input. When the sound source is found, the controller 290 receives the sound source. The found sound source may be pre-stored or may be externally downloaded through the communicator 280. In addition, the controller 290 extracts an accompaniment sound from the sound source. The controller 290 may control the audio outputter 250 to mix and output the corrected song and the accompaniment sound.

Figure 10:
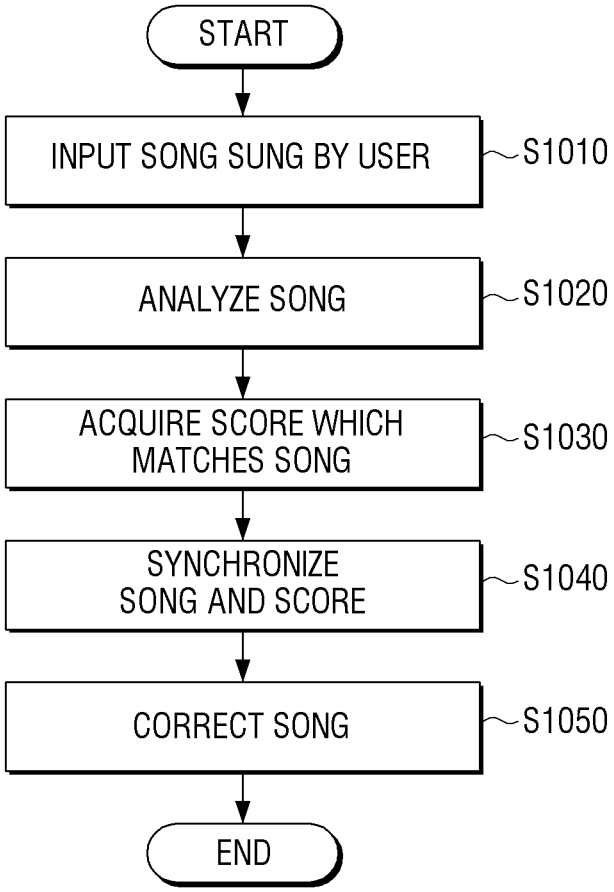
FIG. 10 is a flowchart of a method for correcting a song according to yet another exemplary embodiment.

FIG. 10 is a flowchart of a method for correcting a song according to another exemplary embodiment.

First, the multimedia apparatus 200 receives a song sung by the user (S1010). The multimedia apparatus 200 may receive the song through a microphone or through externally transmitted audio data.

Subsequently, the multimedia apparatus 200 analyzes the song (S1020). More specifically, the multimedia apparatus 200 may analyze a pitch and a beat of the song.

Subsequently, the multimedia apparatus 200 acquires a score which matches the song (S1030). More specifically, the multimedia apparatus 200 may acquire a virtual score using the analyzed pitch and beat, compare the virtual score with the scores stored in the database, and determine that a score which is the most similar to the virtual score is the score which matches the song.

The multimedia apparatus 200 then synchronizes the song and the acquired score (S1040). More specifically, the multimedia apparatus 200 may synchronize the song and the acquired score in a DTW method.

Subsequently, the multimedia apparatus 200 corrects the song based on the acquired score (S1050). More specifically, the multimedia apparatus 200 may correct a pitch and a beat of the song to correspond to the score by applying time stretching and a frequency shift.

Using the aforementioned song correction method, general users who do not sing well may easily and conveniently correct their song so as to be suitable as an original song.

The music composing method or the song correcting method according to the aforementioned exemplary embodiments may be implemented with a program, and may be provided to a display apparatus. Programs including the music composing method or the song correcting method may be stored in a non-transitory computer readable medium.

The non-transitory computer readable medium is a medium which does not store data temporarily such as a register, cache, and memory but stores data semi-permanently and is readable by devices. More specifically, the aforementioned applications or programs may be stored in the non-transitory computer readable medium such as compact disks (CDs), digital video disks (DVDs), hard disks, Blu-ray disks, universal serial buses (USBs), memory cards, and read-only memory (ROM).

The foregoing exemplary embodiments are merely exemplary and are not to be construed as limiting the exemplary embodiments. The exemplary embodiments can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A music composing method comprising:

setting a type of musical instrument digital interface (MIDI) data according to a user's input;

sensing a user interaction;

analyzing the sensed user interaction and determining a beat and a pitch according to the analyzed user interaction;

generating MIDI data using the set type of MIDI data and the determined beat and pitch; and generating at least one of a previous measure of MIDI data and a subsequent measure of MIDI data of the generated MIDI data based on a harmonic characteristic of the generated MIDI data.

2. The method as claimed in claim 1, wherein the setting the type of MIDI data comprises setting at least one from among a beats per minute (BPM), and a complexity of the MIDI data.

3. The method as claimed in claim 1, further comprising:

receiving an image; and obtaining emotion information using at least one from among color information, motion information, and spatial information of the received image, wherein the generating the MIDI data comprises generating the MIDI data by using the emotion information.

4. The method as claimed in claim 1, further comprising:

sensing at least one from among weather, a temperature, a humidity, and an illumination; and generating emotion information using the sensed at least one from among the weather, the temperature, the humidity, and the illumination, wherein the generating the MIDI data comprising generating the MIDI data by using the emotion information.

5. The method as claimed in claim 1, further comprising:

generating a score using the determined beat and the determined pitch; and displaying the generated score.

6. The method as claimed in claim 5, further comprising:

modifying the MIDI data using the displayed generated score.

7. The method as claimed in claim 1, further comprising:

generating a music file using the generated MIDI data, the generated previous measure of MIDI data, and the generated subsequent measure of MIDI data.

8. The method as claimed in claim 1, wherein the user interaction comprises one of a touch made by the user and a motion made by the user.

9. A multimedia apparatus comprising:

an inputter configured to receive a user command to set a type of musical instrument digital interface (MIDI) data;

a sensor configured to sense a user interaction; and a controller configured to analyze the sensed user interaction and determine a beat and a pitch, and configured to generate MIDI data using the set type of MIDI data and the determined beat and pitch, wherein the controller is further configured to generate at least one of a previous measure of MIDI data and a subsequent measure of MIDI data of the generated MIDI data based on a harmonic characteristic of the generated MIDI data.

10. The multimedia apparatus as claimed in claim 9, wherein the inputter receives a user command to set at least one from among a beats per minute (BPM) and a complexity of the MIDI data.

11. The multimedia apparatus as claimed in claim 9, further comprising:

an image inputter configured to receive an image, wherein the controller obtains emotion information using at least one from among color information, motion information, and spatial information of the image received through the image inputter, and generates the MIDI data using the emotion information.

12. The multimedia apparatus as claimed in claim 9, further comprising:

an environment sensor configured to sense at least one from among a weather, a temperature, a humidity, and an illumination, wherein the controller generates emotion information using the at least one from among the weather, the temperature, the humidity, and the illumination, and generates the MIDI data using the emotion information.

13. The multimedia apparatus as claimed in claim 9, further comprising:

a display, wherein the controller generates a score using the determined beat and pitch, and controls the display to display the generated score.

14. The multimedia apparatus as claimed in claim 13, wherein the controller modifies the MIDI data according to a user command which is input onto the displayed score.

15. The multimedia apparatus as claimed in claim 9, wherein the controller generates a music file using the generated MIDI data, the generated previous measure of MIDI data, and the generated subsequent measure of MIDI data.

16. The multimedia apparatus as claimed in claim 9, wherein the user interaction comprises one of a touch made by the user, and a motion made by the user.

17. A method of composing music in a multimedia apparatus, the method comprising:

sensing a user interaction with the multimedia apparatus;

determining a beat and a pitch according to the user interaction; and generating musical instrument digital interface (MIDI) data based on the determined beat and pitch of the user interaction, generating at least one of a previous measure of MIDI data and a subsequent measure of MIDI data of the generated MIDI data based on a harmonic characteristics of the generated MIDI data.

* * * * *